US005117890A

United States Patent [19]

Taylor et al.

[11] Patent Number: 5,117,890

[45] Date of Patent: Jun. 2, 1992

[54] PET DOOR

[76] Inventors: Robert Taylor, 3836-27 Street NE., Calgary, Alberta, Canada, T1Y 5K7; David Smith, 238 Scarboro Ave. SW., Calgary, Alberta, Canada, T3C 2H3

[21] Appl. No.: 692,256

[22] Filed: Apr. 26, 1991

[51] Int. Cl.[5] ..... E06B 7/28

[52] U.S. Cl. ..... 160/180; 160/DIG. 8

[58] Field of Search ..... 160/180, 116, 354, 181, 160/353, 380, DIG. 8; 49/168, 169, 170, 171

[56] References Cited

U.S. PATENT DOCUMENTS

| | | | |
|---|---|---|---|
| 2,758,646 | 8/1956 | Johnson | 160/354 |
| 3,797,554 | 3/1974 | Johnson | 160/354 |
| 3,985,174 | 10/1976 | Bricker | 160/180 |
| 4,053,007 | 10/1977 | Griffith | 160/180 |
| 4,334,573 | 6/1982 | Hackman et al. | 160/180 |
| 4,408,416 | 10/1983 | Davlantes | 49/168 |
| 4,451,997 | 6/1984 | Jones | 160/380 X |
| 4,603,724 | 8/1986 | Borwick | 160/180 |
| 4,651,793 | 3/1987 | Davlantes | 160/116 X |
| 4,754,797 | 7/1988 | Sronce | 160/180 X |
| 4,760,872 | 8/1988 | Hale | 160/180 X |

*Primary Examiner*—David M. Purol

*Attorney, Agent, or Firm*—Shlesinger, Arkwright & Garvey

[57] ABSTRACT

In general, existing pet doors are unnecessarily complicated and consequently expensive to produce and/or install. The pet door of the present invention overcomes these problems and provides a readily visible indication of whether a pet is inside or outside a house. The pet door disclosed herein includes a pair of simple rectangular frames carrying a flexible flap with a weighted bottom end for overhanging inner and outer ledges on the bottom ends of the frames, inside or outside of the frames depending upon the location of the pet, i.e. a pet moving through the door will push the flap through the frames, the weight returning the flap to a closed position in the frames with the weight against one bottom ledge.

5 Claims, 3 Drawing Sheets

PET DOOR

BACKGROUND OF THE INVENTION

This invention relates to a pet door, and in particular to a pet door for use in a screen door.

The use of pet doors is a convenient method of allowing a pet free movement into and out of a dwelling. However, for most people, the usually complicated and expensive construction of pet doors outweighs their convenience. Other disadvantages of pet doors are the free entry of uninvited guests such as insects via unsealed or partly open pet doors, and the lack of any indication whether the animal is inside or outside the house.

U.S. Pat. Nos. 4,334,573, issued to La Vona R. Hackman et al on Jun. 15, 1982 and 4,603,724, issued to Michael J. Borwick on Aug. 5, 1986 describe pet doors for use in screen doors. While the Hackman et al device, is relatively simple, it does not provide a seal around the door sufficient to prevent the passage of insects. The Borwick device is difficult to install, and utilizes a complicated and expensive frame. Moreover, neither device provides an indication of whether an animal is inside or outside the house.

An object of the present invention is to alleviate the above mentioned difficulties by providing a relatively simple, inexpensive pet door, which can easily be installed in an existing screen door.

Another object of the invention is to provide a pet door, which enables the pet owner to determine at a glance whether the pet is inside or outside the house.

Yet another object of the invention is to provide a pet door, which returns to a closed position after the passage of a pet therethrough and which is sealed sufficiently in the closed position to prevent insects entering the house.

BRIEF DESCRIPTION OF THE INVENTION

Accordingly, the present invention relates to a pet door for installation in a screen door around an opening therein; flexible flap means pivotally connected to the upper end of said frame means and extending downwardly to cover the opening; weight means on the lower end of said flap means overhanging front or rear surface of the lower end of said frame means in a closed position for returning said flap means to a closed position after a pet has passed through the opening in either direction and for providing an indication of whether the pet is inside or outside the door.

BRIEF DESCRIPTION OF THE DRAWINGS

The invention will be described in greater detail with reference to the accompanying drawings, which illustrate a preferred embodiment of the invention, and wherein.

DESCRIPTION OF THE PREFERRED EMBODIMENTS

Figure 1:
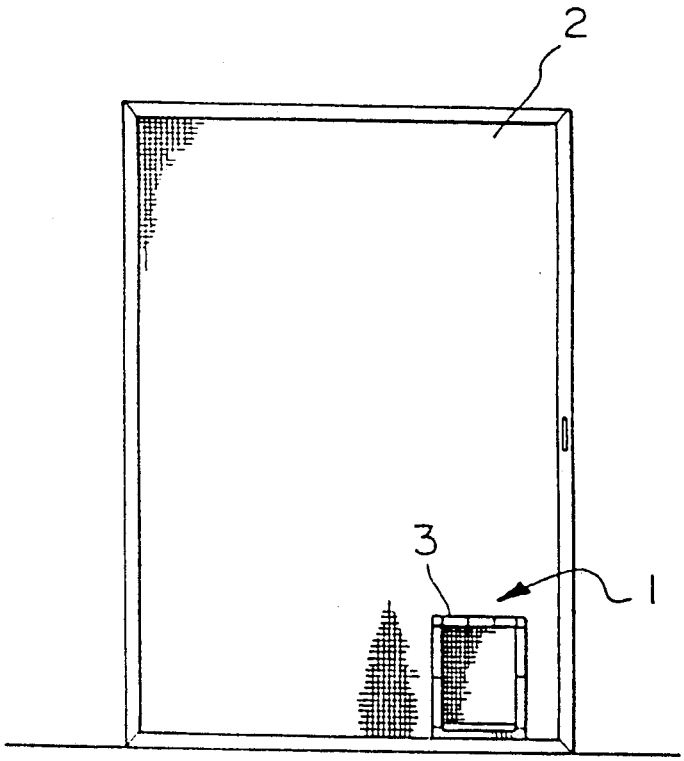
FIG. 1 is a schematic front view of the pet door of the present invention installed in a screen door.

With reference to FIG. 1, the pet door of the present invention which is generally indicated at 1 is intended for use in a conventional screen door 2. The pet door 1 is installed at any location proximate the bottom of the screen door 2 by cutting a rectangular opening in the latter. The pet door 1 includes a pair of identical rectangular frames 3 bordering the opening in the screen door 2, one on either side thereof. Each frame 3 includes a pair of planar sides 5 and top and bottom ends 6 and 7, respectively defining an opening which is slightly smaller than the opening in the screen door 2. Vertical flanges 8 extend outwardly from the inner edges of the sides 5. Horizontal ledges 10 and 11 extend outwardly from the lower edge of the top end 6 and the upper edge of the bottom end 7, respectively.

The flanges 8 and the ledges 10 and 11 are integral with each other and with the sides 5 and the ends 6 and 7, and define a border around the opening in the frame 3. The flanges 8 extend between the top and bottom ends 6 and 7, respectively of the frames 3, and the ledges 10 and 11 extend between the ends of the flanges 8. The ledges 10 and 11 are narrower, i.e. extend outwardly a shorter distance from the sides 5 and ends 6 and 7 than the flanges 8 (for the reason stated hereinafter). Gussets 13 extend between the sides 5 and the flanges 8, and between the ends 6 and 7 and the ledges 10 and 11, respectively for strengthening the frames 3. The use of the above described structure permits the production of strong one-piece frames 3 using simple injection molding techniques.

Figure 4:
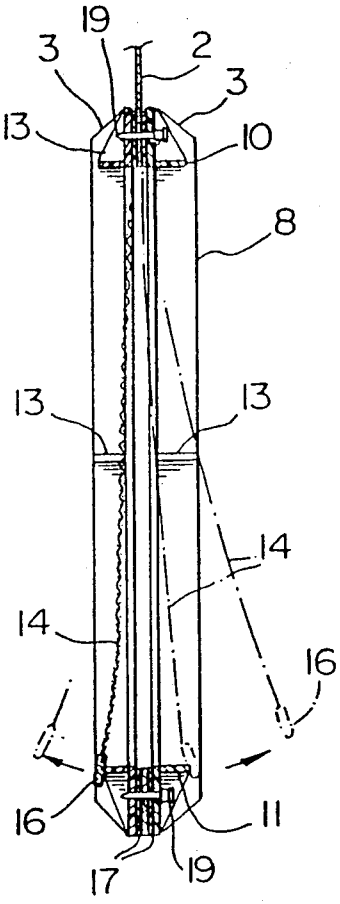
FIG. 4 is a cross section taken generally along line IV—IV of FIG. 3.
Figure 3:
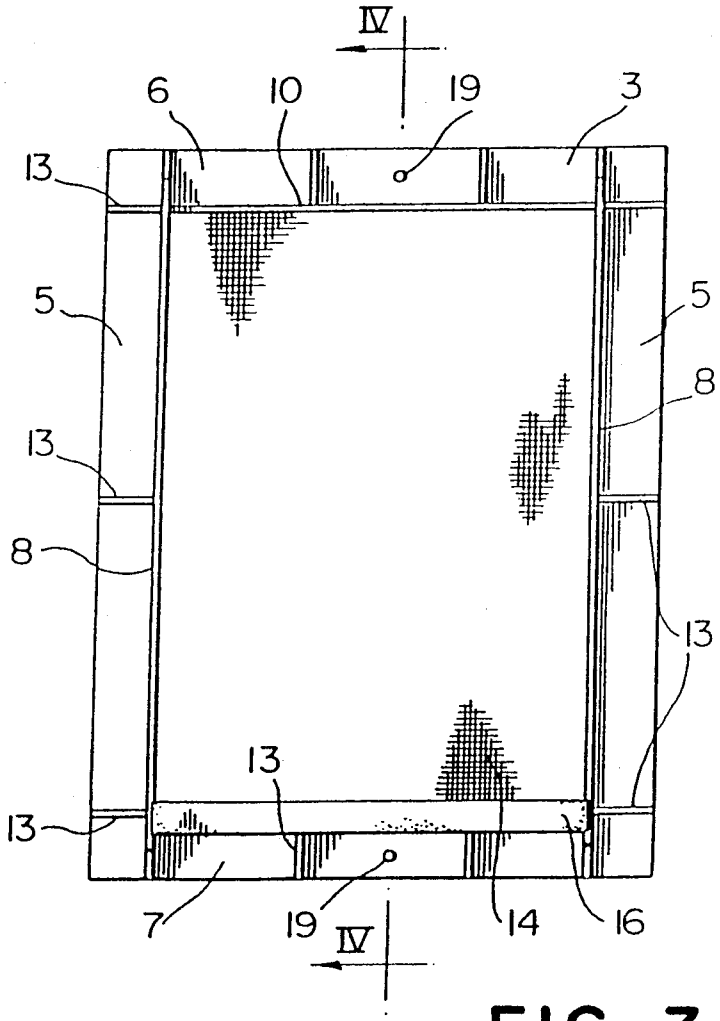
FIG. 3 is a front view of the pet door of FIG. 2.

A flexible flap 14 is pivotally connected to the inner surface of the top end 6 of one frame 3. The flap 14, which is formed of a rectangular piece of screen, normally hangs between the flanges 8. The colour of the flap 14 is preferably different from the normal dark screen colour, so that the pet door stands out from the remainder of the screen door. A thin, rectangular weight 16 is attached to and is coextensive with the bottom edge of the flap 14. As best seen in FIG. 4 the length of the flap 14 is such that the weight 13 slightly overhangs the lower ledge 11.

During installation, the first step is to cut an opening in the screen door 2, the frames 3 are then mounted in back-to-back relationship on opposite sides of the door 2.

Figure 2:
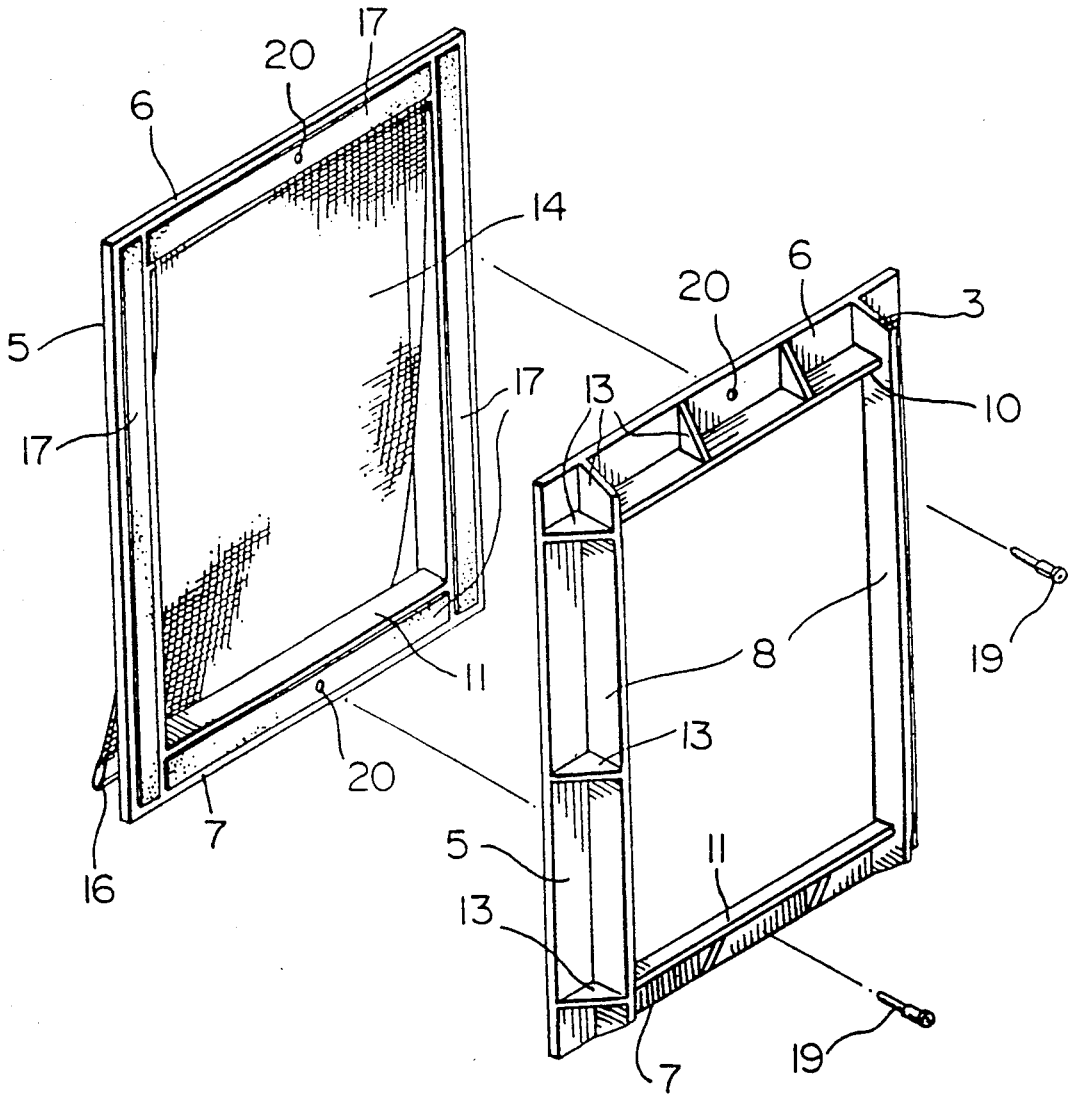
FIG. 2 is an exploded, isometric view of the pet door of FIG. 1 on a larger scale.

Adhesive strips 17 (FIG. 2) extending along the back surfaces of the sides 5 and ends 6 and 7 help to connect the frames 3 to the screen door 2 and provide a seal around the periphery of the device. The adhesive on the strips 17 is normally covered by thin, removable plastic covers (not shown), which are removed immediately prior to mounting of the frames 3 on the screen door 2. Pins 19 extend through holes 20 (FIG. 2) in the centres of the top and bottom ends 6 and 7 of the frames 3 and through the screen door 2 for aligning and interconnecting the frames 3.

In use, the flap 14 is placed inside the frames 3, i.e. the flap 14 is inside the screen door 2 (as seen in broken outline in FIG. 4) with the weight 16 overhanging the ledge 11 of the inner frame 3. When a pet leaves the house, he will force the flap 14 and the weight 16 through the opening to a position remote from the frames 3. The weight 16 causes the flap 14 to return to a position against the ledge 11 of the outer frame 3. The weight 16 not only maintains the flap 14 closed, but provides a simple, readily visible indication of whether the pet is inside or outside the house.

The flanges 8 extend farther outwardly than the ledges 10 and 11 to ensure that there are no gaps between the flap 14 and the flanges 8 and the ledge 11. If the bottom ledge 11 extended outward the same distance as the flanges 8, there would be a small gap between the bottom side edges of the flap 14 and the flanges 8.

Thus, there has been described a relatively simple, easily installed pet door, which provides a readily visible indication of whether a pet is in or out.

What is claimed is:

1. A pet door, comprising:

(a) frame means for mounting on an exterior door of a dwelling, said frame means defining an opening therethrough, said opening having a bottom edge;

(b) said frame means having top and bottom portions and dwelling and outdoor sides;

(c) flexible flap means being secured at said top portion, said flap means covering said opening;

(d) said flap means including a bottom portion extending below said opening bottom edge and overlying said frame means bottom portion, said flap means being displaced when a pet goes through said opening, (e) weight means disposed at said flap means bottom portion for urging said flap means in a closed position; and (f) said flap means bottom portion being positioned in one of said dwelling and outdoor sides when the pet uses said door, thereby providing an indication whether the pet is inside the dwelling or outside.

2. A pet door as in claim 1, wherein:

(a) said frame means lower portion includes a recess on each of said dwelling and outdoor sides; and (b) said flap means lower portion is received in said recess.

3. A pet door as in claim 2, wherein:

(a) said frame means comprises a frame having left and right vertical members and upper and lower horizontal members;

(b) said left and right vertical members each has a first thickness and said lower horizontal member has a second thickness in a direction transverse to said opening;

(c) said first thickness is greater than said second thickness; and (d) said lower horizontal member is disposed relative to the said left and right vertical members such that said recess is formed.

4. A pet door as in claim 1, wherein:

(a) said frame means comprises first and second frames secured back to back to each other.

5. A pet door as in claim 4, wherein:

(a) said first and second frames each includes coplanar wall portion and transverse wall portions extending from said coplanar wall portion; and (b) a plurality of gussets secured to said coplanar wall portion and said transverse wall portions.

* * * * *